US007491256B2

(12) United States Patent
Andersson

(10) Patent No.: US 7,491,256 B2
(45) Date of Patent: Feb. 17, 2009

(54) IRON-BASED POWDER COMPOSITION

(75) Inventor: Olof Andersson, Helsingborg (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 11/578,942

(22) PCT Filed: Apr. 25, 2005

(86) PCT No.: PCT/SE2005/000597

§ 371 (c)(1),
(2), (4) Date: Nov. 8, 2006

(87) PCT Pub. No.: WO2005/102567

PCT Pub. Date: Nov. 3, 2005

(65) Prior Publication Data

US 2007/0199409 A1 Aug. 30, 2007

(30) Foreign Application Priority Data

Apr. 26, 2004 (SE) ..... 0401086

(51) Int. Cl.
*C22C 1/05* (2006.01)
*C22C 33/02* (2006.01)

(52) U.S. Cl. ..... 75/231; 75/253; 75/254

(58) Field of Classification Search ..... 75/231, 75/246, 253, 254; 508/106
See application file for complete search history.

(56) References Cited

U.S. PATENT DOCUMENTS

| | | | | |
|---|---|---|---|---|
| 4,836,848 | A | 6/1989 | Mayama et al. | |
| 4,927,461 | A * | 5/1990 | Ciloglu et al. | 75/254 |
| 5,631,431 | A * | 5/1997 | Andersson | 75/230 |
| 2001/0037842 | A1 | 11/2001 | Hayashi et al. | |
| 2003/0097902 | A1 | 5/2003 | Takiguchi et al. | |
| 2003/0230164 | A1 * | 12/2003 | Henmi et al. | 75/231 |
| 2004/0182200 | A1 * | 9/2004 | Takiguchi et al. | 75/246 |
| 2005/0040358 | A1 * | 2/2005 | Chikahata et al. | 251/368 |

FOREIGN PATENT DOCUMENTS

EP 1300481 A2 4/2003

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

The invention concerns an iron-based powder composition comprising, in addition to the iron-based powder, 0.02% and 1.0%, weight of a machinability improving additive, comprising calcium fluoride and hexagonal boron nitride. The invention also concerns the additive per se.

9 Claims, No Drawings

IRON-BASED POWDER COMPOSITION

TECHNICAL FIELD OF THE INVENTION

The invention refers to a powder metal composition for production of powder metal parts. Especially the invention concerns a powder metal composition including a new machinability improving additive.

BACKGROUND OF THE INVENTION

One of the major advantages of powder-metallurgical manufacture of components is that it becomes possible, by compacting and sintering, to produce blanks of final or very close to final shape. There are however instances where subsequent machining is required. For example, this may be necessary because of high tolerance demands or because the final component has such a shape that it cannot be pressed directly but requires machining after sintering. More specifically, geometries such as holes transverse to the compacting direction, undercuts and threads, call for subsequent machining.

By continuously developing new sintered steels of higher strength and thus also higher hardness, machining has become one of the major problems in powder-metallurgical manufacture of components. It is often a limiting factor when assessing whether powder-metallurgical manufacture is the most cost-effective method for manufacturing a component. Hence, there is a great need for new and more effective additives to improve the machinability of sintered steels. It is then important that this additive does not appreciably affect the mechanical properties, such as tensile strength and elongation, of the sintered material.

Today, there are a number of known substances which are added to iron-based powder mixtures to facilitate the machining of components after sintering. The most common powder additive is MnS, which is mentioned e.g. in EP 0 183 666, describing how the machinability of a sintered steel is improved by the admixture of such powder. Materials which are difficult to machine, in this context materials having a hardness above about 180 HV, cannot however be machined properly by adding MnS. Moreover, depending of added amount and base-material, additions of MnS may reduce the mechanical strength of the material after sintering.

WO 91/14526 describes how small amounts of Te and/or Se together with MnS are used to improve the machinability about twice in powder-metallurgical materials that are difficult to machine. The addition of Te and/or Se is already conflicting with environmetal considerations, in that the hygienic limit values for these additives are very low and there is a tendency towards even more stringent environmental regulations.

U.S. Pat. No. 4,927,461 describes the addition of hexagonal BN (boron nitride) to iron-based powder mixtures to improve machinability of the metal part after sintering. In the patent it is stated that by using agglomerates of very fine BN powder, it is possible to achieve a similar improvement of the machinability as by the addition of MnS. However, the sintered strength is affected to a lesser extent if a correct amount of BN powder is added, than if MnS is added.

Also the U.S. Pat. No. 5,631,431 relates to an additive for improving the machinability. According to this patent the additive contains calcium fluoride particles which are included in an amount of 0.1-0.6% by weight in the powder composition. In practice calcium fluoride has turned out to be an excellent machinability improving agent. However due to the continuous development of PM materials there is a need to improve the performance of the additives as well.

Thus an object of the present invention is to provide a new additive for a powder metal composition for further improvement of machinability. Another object of the invention is to provide a new additive which has no or essentially no influence of the mechanical properties. Additionally the new additive should be environmentally acceptable.

SUMMARY OF THE INVENTION

According to the present invention it has now been found, that by combining calcium fluoride and hexagonal boron nitride, an additive having an unexpectedly high machinability improving effect is obtained. The improvement of the machinability could best be described as a synergetic effect. Additionally this new additive has essentially no or only minor effect on the mechanical properties of the sintered parts. The new additive is also environmentally acceptable. The invention also concerns an iron-based powder composition including this additive.

DETAILED DESCRIPTION OF THE INVENTION

In order to obtain the machinability improving effect the additive should be included in the iron-based composition in an amount of 0.02% and 1.0%, preferably between 0.02% and 0.6% by weight.

Furthermore, both the type and the amount of the components of the new additive are important. Thus the amount of hexagonal boron nitride should be in the range 0.01% to 0.5 wt %, preferably 0.01-0.2 wt % of the iron based powder composition. The amount of calcium fluoride should be in the range 0.01% to 0.5%, preferably 0.1% to 0.4% wt % of the iron based powder composition. Lower amounts, than the above mentioned, of both hexagonal boron nitride and calcium fluoride will respectively, together or alone not give the intended effect on machinability and higher amounts will affect mechanical properties negatively. Furthermore, it is preferred that the amount of calcium fluoride is higher than the amount of boron nitride.

As regards the particle size of the components included in the new additive it has been found that the average particle size of the hexagonal boron nitride according to the invention may vary between 1 to 50 μm, preferably between 1 to 30 μm. Preferably the hexagonal boron nitride is non-agglomerated plate-like particles.

The mean particle size of the calcium fluoride is less than about 100 μm, preferably between 20 to 70 μm. A mean particle size above 100 μm will negatively effect the machinability and mechanical properties and below 20 μm the machinability improving effect becomes lesser.

Iron-based Powder Types

This new machinability improvement powder additive can be used in essentially any ferrous powder composition. Thus the iron-based powder may be a pure iron powder such as an atomized iron powder, a reduced powder, and the like. Prealloyed water atomized powders including alloying elements are of most interest, but also partially alloyed steel powders. Of course, these powders may be used in combination.

Other Additives

The powder composition according to the invention may also include additives such as graphite, other alloying elements such as Ni, Mo, Cr, V, Co, Mn or Cu, binders and lubricants and other conventional machinability improving agents such as MnS.

Process

The powder-metallurgical manufacture of components comprising the additive according to the invention is performed in a conventional manner, i.e. most often by the following process steps:

The iron-based powder, i.e. the iron or steel powder, is admixed with graphite and desired optional alloying elements, such as nickel, copper, molybdenum as well as the additive according to the invention in powder form. The alloying elements may also be added as prealloyed or diffusion alloyed iron based powders or as a combination between admixed alloying elements, diffusion alloyed powder or prealloyed powder. This powder mixture is admixed with a conventional lubricant, for instance zinc stearate or ethylenebisstearamide, prior to compacting. Finer particles in the mix may be bonded to the iron based powder by means of a binding substance. The powder mixture is thereafter compacted in a press tool yielding what is known as a green body of close to final geometry. Compacting generally takes place at a pressure of 400-1200 MPa. After compacting, the compact is sintered and is given its final strength, hardness, elongation etc.

The machinability improving additive according to the invention consists of pulverulent calcium fluoride and pulverulent hexagonal boron nitride. It has been found that a remarkable improvement of machinability is achieved by adding the machinability improving additive in amounts corresponding to a ratio between the amount of hexagonal boron nitride and calcium fluoride which is less than 1:1 but not less than 1:40, preferably not less than 1:10. In other words the amount of hexagonal boron nitride should be less than the amount of calcium fluoride to a certain extent.

The present invention will be illustrated in the following non-limiting examples:

EXAMPLE 1 a) Investigation of Mechanical Properties

Different kinds of hexagonal boron nitride according to Table 1 were investigated. Hexagonal boron nitride type I is a powder of non-agglomerated particles and type II is agglomerates of sub-micron particles, i.e. the particles of the agglomerate having a particle size below 1 μm.

TABLE 1

| Analysis | h-BN type I | h-BN type II |
|---|---|---|
| BN [%] | 99 | 96 |
| O-tot [%] | 0.5 | 3 |
| Average particle size [μm] | >1 | >1* |

TABLE 1-continued

| Analysis | h-BN type I | h-BN type II |
|---|---|---|
| Screen analysis (90% min.) [mesh] | −400 | −325* |
| Specific area [$m^2/g$] | 5 | 25 |

*Agglomerated particle of sub-micron particles

Hexagonal boron nitride and calcium fluoride were mixed in different amounts, according to Table 2, with a metal powder Distaloy® AE, available from Höganäs AB, which is pure iron diffusion alloyed with Mo, Ni and Cu. The metal powder was also mixed with a lubricant, 0.8% EBS (etylenbisstearamide) and 0.5% of graphite.

The material mixes in Table 2 were compacted to a green density of 7.10 $g/cm^3$ to standardised tensile test bars according to ISO 2740. The test bars were sintered in a laboratory mesh belt furnace at 1120° C. for 30 minutes in a mix of 10% hydrogen and 90% nitrogen. The sintered test bars were used to determine tensile strength according to EN 10001-1, hardness according to ISO 4498/1 and dimensional change according to ISO 4492.

TABLE 2

| Mix | h-BN type I [%] | h-BN type II [%] | $CaF_2$ [%] | DC [%] | HV10 [MPa] | TS [MPa] | A [%] |
|---|---|---|---|---|---|---|---|
| 1-1a | 0.2 | 0 | 0 | −0.137 | 223 | 711 | 2.31 |
| 1-2a | 0.4 | 0 | 0 | −0.094 | 206 | 634 | 2.00 |
| 1-3a | 0 | 0.2 | 0 | −0.019 | 157 | 459 | 1.48 |
| 1-4a | 0 | 0.4 | 0 | 0.131 | 135 | 285 | 0.64 |
| 1-5a | 0 | 0 | 0.2 | −0.203 | 228 | 728 | 2.81 |
| 1-6a | 0 | 0 | 0.4 | −0.205 | 239 | 730 | 2.68 |
| 1-7a | 0.3 | 0 | 0.1 | −0.130 | 217 | 629 | 2.24 |
| 1-8a | 0.1 | 0 | 0.3 | −0.177 | 222 | 686 | 2.61 |
| 1-9a | 0 | 0 | 0 | −0.187 | 245 | 721 | 2.41 |

DC is change in length for the tensile strength bar during sintering.
SD is the sintered density for the tensile strength bar.
HV10 is the Vickers hardness for the tensile strength bar.
TS is the tensile strength for the tensile strength bar.
A is the plastic elongation during the tensile strength test.

As can be seen in Table 2 added amounts of 0.2% and 0.4% of h-BN type II to Distaloy AE have an impact on the mechanical properties of the sintered body, whereas additions of 0.2% h-BN type I only have a minor impact on the mechanical properties of the sintered body.

b) Investigation of Machinability Index

To determine the machinability with different additive compositions, as can be seen in Table 3, discs with a diameter of 80 mm and a height of 12 mm, were compacted to a green density of 7.10 $g/cm^3$. The discs were sintered in a laboratory mesh belt furnace at 1120° C. for 30 minutes in a mix of 10% hydrogen and 90% nitrogen. The discs were used in drill tests to determine a machinability index. This index is defined as the average number of holes per drill that can be machined before the drill is worn out. Drilling was performed with high speed steel drills at constant speed and constant feed without any coolant.

As can be seen in Table 3 the machinability index is improved by using either the additive h-BN or the additive $CaF_2$. However, a remarkable improvement can be seen by using the h-BN (type I) and $CaF_2$ in combination.

TABLE 3

| Mix | h-BN type I [%] | $CaF_2$ [%] | M. Index [Bore] | Gain [n] |
|---|---|---|---|---|
| 1-1b | 0.2 | 0 | 504 | 5.7 |
| 1-2b | 0 | 0.3 | 181 | 2.0 |
| 1-3b | 0.1 | 0.3 | 1438 | 16.3 |
| 1-4b | 0 | 0 | 88 | 1 |

M. Index is the average number of possible holes to drill in a disc of the material with one drill.
Gain is the amplification in machinability, compared with mix 1-4b.

EXAMPLE 2

Hexagonal boron nitride, type I, and $CaF_2$ were mixed in different amounts, according to Table 4, with a metal powder Distaloy® DH-1 from Höganäs AB, which is iron pre-alloyed with 1.5% Mo and thereafter diffusion alloyed with 2% Cu. The metal powder was also mixed with a lubricant, 0.8% EBS (etylenbisstearamide) and different amounts of graphite. The material mixes in Table 4 have been compacted to different densities to standardised tensile test bars according to ISO 2740, and discs with a diameter of 80 mm and a height of 12 mm were prepared in order to determine the machinability. The test bars and the discs were sintered in a laboratory mesh belt furnace at 1120° C. for 30 minutes in a mix of 10% hydrogen and 90% nitrogen. The sintered test bars were used to determine tensile strength according to EN 10001-1, hardness according to ISO 4498/1 and dimensional change according to ISO 4495. The discs were used in drill tests to determine a machinability index. This index is defined as the average number of holes per drill that can be machined before the drill is worn out. Drilling was performed with high speed steel drills at constant speed and constant feed without any coolant.

Table 4 shows that when h-BN type 1 is added to Distaloy DH-1, the sintered body will have lower hardness and tensile strength. As h-BN may diminish the solubility of graphite in the matrix the reason for the lower hardness and tensile strength is believed to be caused by a lower amount of dissolved graphite, some of the graphite is believed to be present as free graphite. A lower hardness of the sintered body may be favourable in terms of machinability. However, when the amount of added graphite is increased in order to compensate for the amount of free graphite, still a remarkable increase of the machinability index is achieved for the samples containing a combination of h-BN and $CaF_2$. This can be seen when comparing the results for samples 2-8, 2-10 and 2-11.

TABLE 4

| Mix | h-BN type I [%] | $CaF_2$ [%] | GR [%] | GD [g/cm$^3$] | DC [%] | HV10 [MPa] | TS [MPa] | A [%] | M. Index [Bore] |
|---|---|---|---|---|---|---|---|---|---|
| 2-1 | 0.1 | 0 | 0.6 | 7.1 | 0.139 | 191 | 630 | 1.43 | 17 |
| 2-2 | 0.1 | 0.1 | 0.6 | 7.1 | 0.135 | 209 | 636 | 1.36 | 143 |
| 2-3 | 0.1 | 0.3 | 0.6 | 7.1 | 0.122 | 205 | 628 | 1.31 | 376 |
| 2-4 | 0.2 | 0 | 0.6 | 7.1 | 0.168 | 188 | 564 | 1.18 | 84 |
| 2-5 | 0 | 0.1 | 0.6 | 7.1 | 0.062 | 236 | 709 | 1.40 | 112 |
| 2-6 | 0 | 0.3 | 0.6 | 7.1 | 0.069 | 244 | 697 | 1.27 | 130 |
| 2-7 | 0 | 0 | 0.6 | 7.1 | 0.077 | 223 | 703 | 1.45 | 17 |
| 2-8 | 0 | 0 | 0.6 | 7.0 | 0.054 | 197 | 621 | 1.11 | 11 |
| 2-9 | 0.1 | 0.1 | 0.75 | 7.0 | 0.045 | 207 | 621 | 0.89 | 23 |
| 2-10 | 0.1 | 0.3 | 0.75 | 7.0 | 0.063 | 215 | 618 | 0.91 | 405 |
| 2-11 | 0.2 | 0 | 0.9 | 7.0 | 0.088 | 191 | 579 | 0.83 | 10 |
| 2-12 | 0.2 | 0.1 | 0.9 | 7.0 | 0.076 | 198 | 606 | 0.77 | 34 |
| 2-13 | 0.2 | 0.3 | 0.9 | 7.0 | 0.074 | 207 | 596 | 0.71 | 147 |

GR is the added amount of graphite expressed in wt %
GD is the compacted green density
DC is change in length for the tensile strength bar during sintering.
SD is the sintered density for the tensile strength bar.
HV10 is the Vickers hardness for the tensile strength bar.
TS is the tensile strength for the tensile strength bar.
A is the plastic elongation during the tensile strength test.
M. Index is the average number of possible holes to drill in a disc of the material with one drill.

The invention claimed is:

1. An iron-based powder composition comprising, in addition to an iron-based powder, between 0.02% and 0.6% by weight of a machinability improving additive, said additive comprising 0.01% to 0.5% by weight calcium fluoride and 0.01% to 0.5% by weight non-agglomerated hexagonal boron nitride and optional additives, wherein the amount ratio between the non-agglomerated hexagonal boron nitride and calcium fluoride is between 1:1 and 1:10.

2. An iron-based powder composition according to claim 1, wherein the average particle size of the non-agglomerated hexagonal boron nitride is 1 to 50 μm.

3. An iron-based powder composition according to claim 1, wherein the average particle size of the calcium fluoride is less than 100 μm.

4. An iron-based powder composition according to claim 1, wherein said composition also includes at least one additive selected from the group consisting of graphite, binder or lubricant.

5. A sintered product having an improved machinability which is prepared from the iron-based composition according to claim 1.

6. An iron-based powder composition according to claim 1, wherein the amount of non-agglomerated hexagonal boride nitride is in the range of 0.01% and 0.2% by weight.

7. An iron-based powder composition according to claim 1, wherein the amount of calcium fluoride is in the range of 0.1% to 0.4% by weight.

8. An iron-based powder composition according to claim 1, wherein the average particle size of the non-agglomerated hexagonal boron nitride is 1 to 30 μm.

9. An iron-based powder composition according to claim 1, wherein the average particle size of the calcium fluoride is 20 to 70 μm.

* * * * *